US007668296B2

(12) United States Patent
Schaefer et al.

(10) Patent No.: US 7,668,296 B2
(45) Date of Patent: Feb. 23, 2010

(54) X RAY TUBE ASSEMBLY AND METHOD OF MANUFACTURING AND USING THE X RAY TUBE ASSEMBLY

(75) Inventors: Thomas Schaefer, Brookfield, WI (US); Ron Hockersmith, Waukesha, WI (US); Ethan Westcot, Wauwatosa, WI (US)

(73) Assignee: General Electric Co., Schenectady, NY (US)

( * ) Notice: Subject to any disclaimer, the term of this patent is extended or adjusted under 35 U.S.C. 154(b) by 15 days.

(21) Appl. No.: 11/763,175

(22) Filed: Jun. 14, 2007

(65) Prior Publication Data

US 2008/0310593 A1 Dec. 18, 2008

(51) Int. Cl.
*H01J 35/06* (2006.01)

(52) U.S. Cl. ..... 378/136; 378/137

(58) Field of Classification Search ..... 378/119, 378/121, 122, 136, 137; 313/310; 445/28
See application file for complete search history.

(56) References Cited

U.S. PATENT DOCUMENTS

| | | | | |
|---|---|---|---|---|
| 4,673,842 | A * | 6/1987 | Grieger et al. | 313/292 |
| 4,764,947 | A * | 8/1988 | Lesensky | 378/138 |
| 5,224,143 | A * | 6/1993 | Dumitrescu et al. | 378/136 |
| 6,480,572 | B2 * | 11/2002 | Harris et al. | 378/136 |
| 6,570,320 | B1 * | 5/2003 | Burkhardt et al. | 313/495 |
| 2003/0040246 | A1 * | 2/2003 | Sugimura et al. | 445/36 |

* cited by examiner

*Primary Examiner*—Jurie Yun

(57) ABSTRACT

In one embodiment, an X ray tube assembly is provided. The X ray tube assembly comprises an evacuated envelope, an anode disposed at a first end of the evacuated envelope and a cathode assembly disposed at a second end of the evacuated envelope. The cathode assembly comprises a cathode filament and a cathode cup defining a plurality of electrically isolated deflection electrodes. Further, the cathode cup comprises at least two portions, a first portion comprising an electrically conductive material and a second portion comprising an electrically insulating material. In another embodiment, a method of manufacturing the X ray tube assembly is provided.

15 Claims, 10 Drawing Sheets

X RAY TUBE ASSEMBLY AND METHOD OF MANUFACTURING AND USING THE X RAY TUBE ASSEMBLY

BACKGROUND OF THE INVENTION

The subject matter described herein generally relates to a radiation generator and more particularly to a method of manufacturing and using an X ray tube assembly in a radiation generator.

Various types of radiation generators have been developed so as to generate electromagnetic radiation. The electromagnetic radiation thus generated can be utilized for various purposes including medical imaging. One such example of a radiation generator is an X ray generator. A typical X ray generator generally comprises an X ray tube assembly for generating electromagnetic radiation (For example, X rays) and a power supply circuit configured to energize the X ray tube assembly in a conventional manner so as to emit X rays through a port and toward a target. The X ray tube assembly generally comprises an evacuated envelope, an anode disposed at a first end of the evacuated envelope and a cathode assembly disposed at a second end of the evacuated envelope. The cathode assembly is configured for emitting an electron beam, which strikes the anode at a focal spot to generate X rays.

The position of the focal spot can be dynamically controlled through electrostatic or electromagnetic means. When using an electrostatic deflection means, it may be desired to have multiple electrically isolated deflection electrodes within close proximity to each other. This allows a wide range of focal spot sizes in length and width, as well as many deflection options. Conventional methods of constructing deflection electrodes typically use metal-ceramic-metal sandwich design. One limitation associated with the conventional methods is difficulties arising due to metal-ceramic brazing, alignment issues, surface contamination, and issues with high voltage standoff.

Hence, there exists a need to provide a system and method for effective control of the focal spot in a radiation generator.

BRIEF DESCRIPTION OF THE INVENTION

The above-mentioned drawbacks and limitations described above are addressed by the present invention.

In one embodiment, a method of manufacturing an X ray tube assembly is provided. The method comprises steps of providing an evacuated envelope, disposing an anode at a first end of the evacuated envelope, disposing a cathode assembly at a second end of the evacuated envelope. The method of disposing the cathode assembly comprises providing a cathode filament configured for emitting an electron beam to impinge on the anode at a focal spot to generate X rays, providing a cathode cup comprising at least two portions, a first portion comprising an electrically conductive material and a second portion comprising an electrically insulating material, drilling at least one slot in the cathode cup and subjecting the cathode cup to a process of electrical discharge machining to form a plurality of electrically isolated deflection electrodes.

In another embodiment, an X ray tube assembly is provided. The X ray tube assembly comprises an evacuated envelope, an anode disposed at a first end of the evacuated envelope and a cathode assembly disposed at a second end of the evacuated envelope. The cathode assembly comprises a cathode filament and a cathode cup defining a plurality of electrically isolated deflection electrodes. Further, the cathode cup comprises at least two portions. A first portion comprises an electrically conductive material and a second portion comprises an electrically insulating material.

In yet another embodiment, a method of operating an X ray tube assembly is provided. The method comprises steps of selectively heating at least a portion of a cathode filament to emit an electron beam, maintaining a voltage potential between an anode and a cathode assembly to cause the electron beam to strike the anode at a focal spot to generate X rays and applying voltage potential individually and selectively to a plurality of electrically isolated deflection electrodes in a cathode cup for controlling the width and location of the focal spot on the anode. Further, the cathode cup comprises at least two portions, a first portion comprising an electrically conductive material and a second portion comprising an electrically insulating material.

In yet another embodiment, a cathode cup for a radiation generator is provided. The cathode cup defining a plurality of electrically isolated deflection electrodes comprises at least two portions, a first portion comprising an electrically conductive material and a second portion comprising an electrically insulating material.

Systems and methods of varying scope are described herein. In addition to the aspects and advantages described in this summary, further aspects and advantages will become apparent by reference to the drawings and with reference to the detailed description that follows.

DETAILED DESCRIPTION OF THE INVENTION

In the following detailed description, reference is made to the accompanying drawings that form a part thereof, and in which is shown by way of illustration specific embodiments, which may be practiced. These embodiments are described in sufficient detail to enable those skilled in the art to practice the embodiments, and it is to be understood that other embodiments may be utilized and that logical, mechanical, electrical and other changes may be made without departing from the scope of the embodiments. The following detailed description is, therefore, not to be taken in a limiting sense.

An imaging apparatus such as a computed tomography system and an X ray imaging device, configured for imaging objects comprises a radiation generator, a radiation detector and a data acquisition system. The radiation generator generates electromagnetic radiation for projection towards the object to be scanned. The electromagnetic radiation includes X rays, gamma rays and other HF electromagnetic energy. The X rays incident on the object being scanned are attenuated by the object. The radiation detector comprises multiple detector elements for converting the attenuated X rays into electrical signals. The electrical signals so formed are named as projection data. The data acquisition system (DAS) samples the projection data from the detector elements and converts the projection data into digital signals for computer processing.

Figure 1:
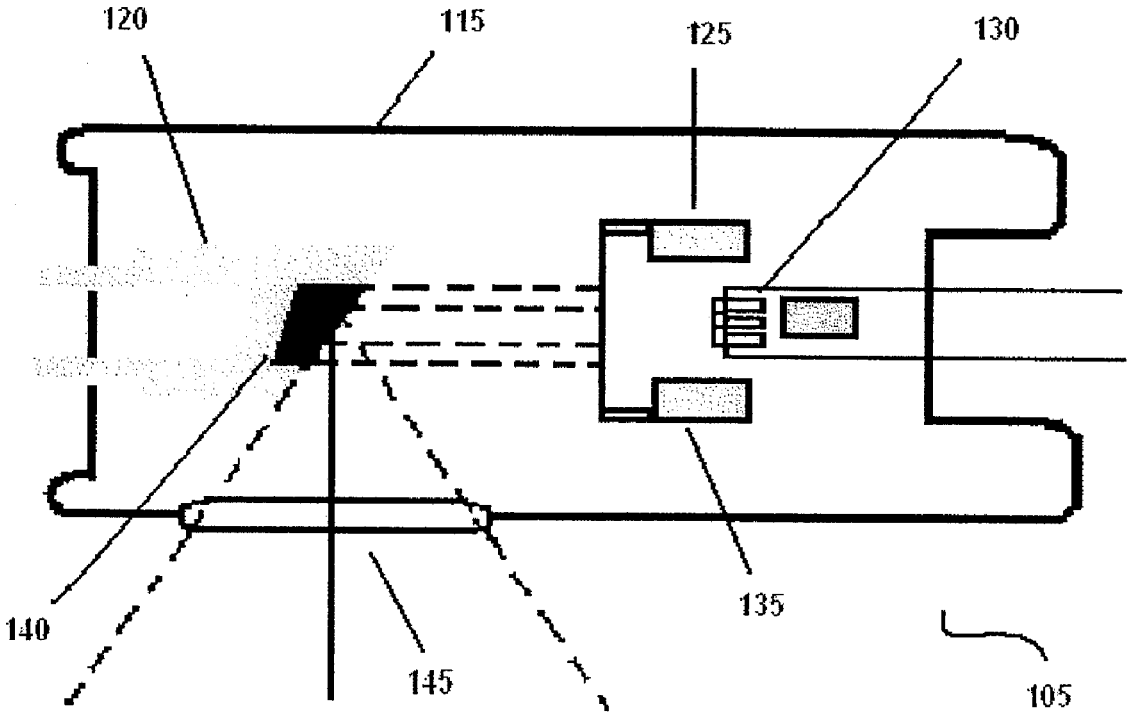
FIG. 1 shows a schematic diagram of an embodiment of a radiation generator.

FIG. 1 shows an exemplary embodiment of the radiation generator. In the illustrated embodiment of FIG. 1, the radiation generator comprises an X ray tube assembly 105 electrically coupled in a conventional manner to a power supply circuit so as to create an emission of X rays. The illustrated X ray tube assembly 105 generally includes an evacuated envelope 115, an anode 120 disposed at a first end of the evacuated envelope 115 and a cathode assembly 125 disposed at a second end of the evacuated envelope 115. The X ray tube assembly 105 shown at FIG. 1 comprises a stationary anode 120 as used for medical diagnostic examinations. However, the X ray tube assemblies with rotary anode or X ray tube assemblies that are not used in the medical field can also be included.

The cathode assembly 125 is located opposite the anode 120 in general alignment along a longitudinal axis of the X ray tube assembly 105. The cathode assembly 125 includes an electron-emitting cathode filament 130 that is capable in a conventional manner of emitting electron beams. The electron beams emitted by the cathode filament 130 are incident on a focal spot on the surface of an anode target 140 in which they generate X rays that can emanate from the X ray tube assembly 105 via a window 145.

Figure 2:
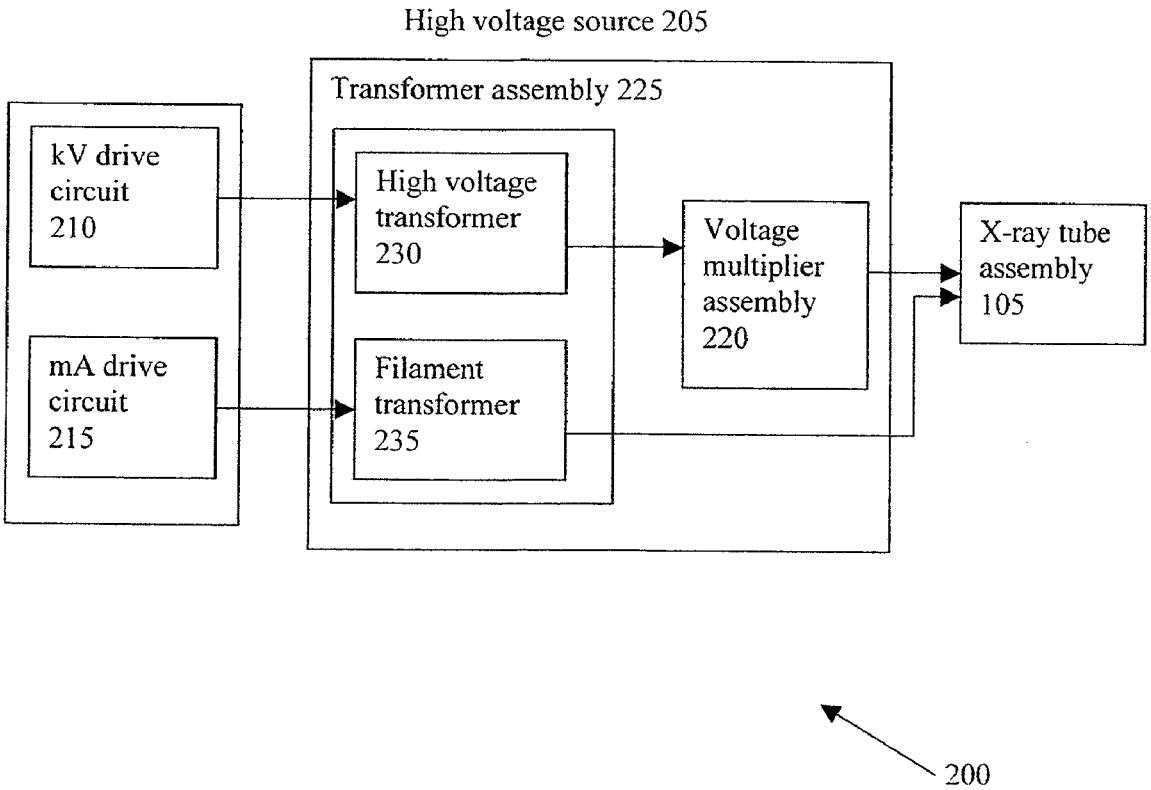
FIG. 2 shows a block diagram of a power supply circuit for a radiation generator in one embodiment.

FIG. 2 shows a block diagram of the power supply circuit 200 coupled to the X ray tube assembly 105. The power supply circuit 200 comprises a high voltage source 205 for maintaining a potential between the anode 120 and the cathode assembly 125 to cause the electron beam to strike the anode 120 at the focal spot to generate X rays.

The power supply circuit 200 comprises two principal power sections; a kV drive circuit 210 and a mA drive circuit 215. The kV drive circuit 210 provides power to the high voltage source 205 to enable the high voltage source 205 to develop the high voltage potentials necessary to generate X rays. The mA drive circuit 215 provides power to the cathode filament 130 for heating the cathode filament 130 so as to emit electrons. The mA drive circuit 215 allows control of the number of electrons boiled off by the cathode filament 130, and thus provides control of the current flow in the X ray tube assembly 105. The power supply circuit 200 also houses a plurality of low voltage power supplies, which are used to furnish biasing voltages to an internal circuitry within the power supply circuit 200.

The input to the power supply circuit 200 is generally a direct current (DC) voltage. However, when the input voltage is an AC voltage, the AC voltage is rectified and then applied to the power supply circuit 200. Accordingly, the radiation generator may further comprise a line rectifier (not shown) configured to provide DC voltage to the power supply circuit 200. An input line power is supplied to the line rectifier (not shown), which converts AC voltage to an unregulated DC voltage. The unregulated DC voltage from the line rectifier (not shown) is applied to the kV drive circuit 210 and the mA drive circuit 215.

The high voltage source 205 is designed to receive an AC waveform from the kV drive circuit 210 and condition the AC waveform to provide a high voltage DC potential to the double-pole supply of the X ray tube assembly 105, where the anode 120 and the cathode assembly 125 carry equal voltages of different polarity. The high voltage source 205 comprises a voltage multiplier assembly 220 and a transformer assembly 225 coupled to the voltage multiplier assembly 220. The voltage multiplier assembly 220 configured to provide the high voltage DC power supply comprises a cathode multiplier and an anode multiplier. The transformer assembly 225 coupled to the voltage multiplier assembly 220 comprises a high voltage transformer 230 and a filament transformer 235 (shown at FIG. 2). The transformer assembly 225 and the voltage multiplier assembly 220 of the high voltage source 205 condition the AC voltage signal transferred by the kV drive circuit 210.

The AC voltage from the kV drive circuit 210 is applied to the primary winding of the high voltage transformer 230 within the high voltage source 205. The high voltage transformer 230 increases the amplitude of the AC square wave voltage at the secondary winding. The high voltage AC signal is applied in turn to the voltage multiplier assembly 220. The voltage multiplier assembly 220 comprises a plurality of serially connected voltage multiplying-rectifying stages having a low voltage potential end and a high voltage potential end. The low voltage potential end is connected to the secondary winding of the high voltage transformer 230 and the high voltage potential end is connected to the tube electrodes 120 and 125 of the X ray tube assembly 105. The voltage multiplier assembly 220 converts the AC signal to two equal DC voltages of different polarities and increases the voltage level. The DC voltage is then applied to the tube electrodes 120 and 125 of the X ray tube assembly 105.

In parallel with the multiple-stage voltage multiplier assembly 220 is the filament transformer 235 producing AC filament heating output currents for the cathode filament 130. The AC voltage generated by the mA drive circuit 215 is applied to the input of the filament transformer 235. The filament transformer 235 provides voltages appropriate for driving the cathode filament 130 in the X ray tube assembly 105.

Figure 3:
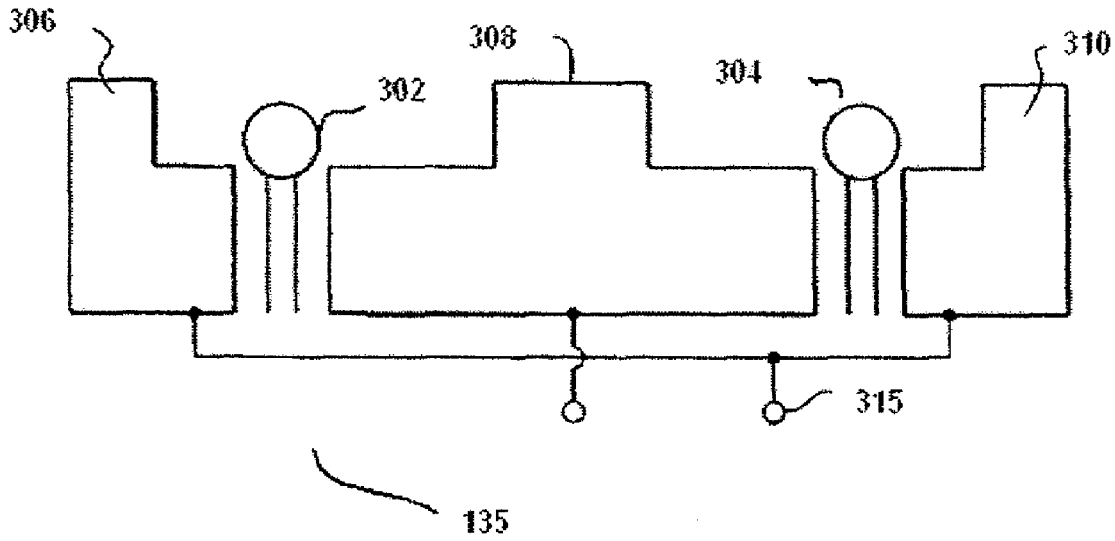
FIG. 3 shows a schematic diagram of a cathode cup in an embodiment.

In one embodiment, the cathode assembly 125 may comprise one or more cathode filaments. Generally, the cathode filaments are used individually to provide a choice of multiple operating focal spots. Referring now to FIG. 3, a simplified cross-sectional view of a multifilament cathode assembly 125 may be seen. The cathode assembly 125 includes two cathode filaments 302 and 304, each cathode filaments 302 and 304 configured for emitting a divergent electron beam. The electrons are accelerated along trajectories extending substantially perpendicular to the cathode filaments 302 and 304, subsequent to which the electrons are focused on the focal spot.

Figure 4:
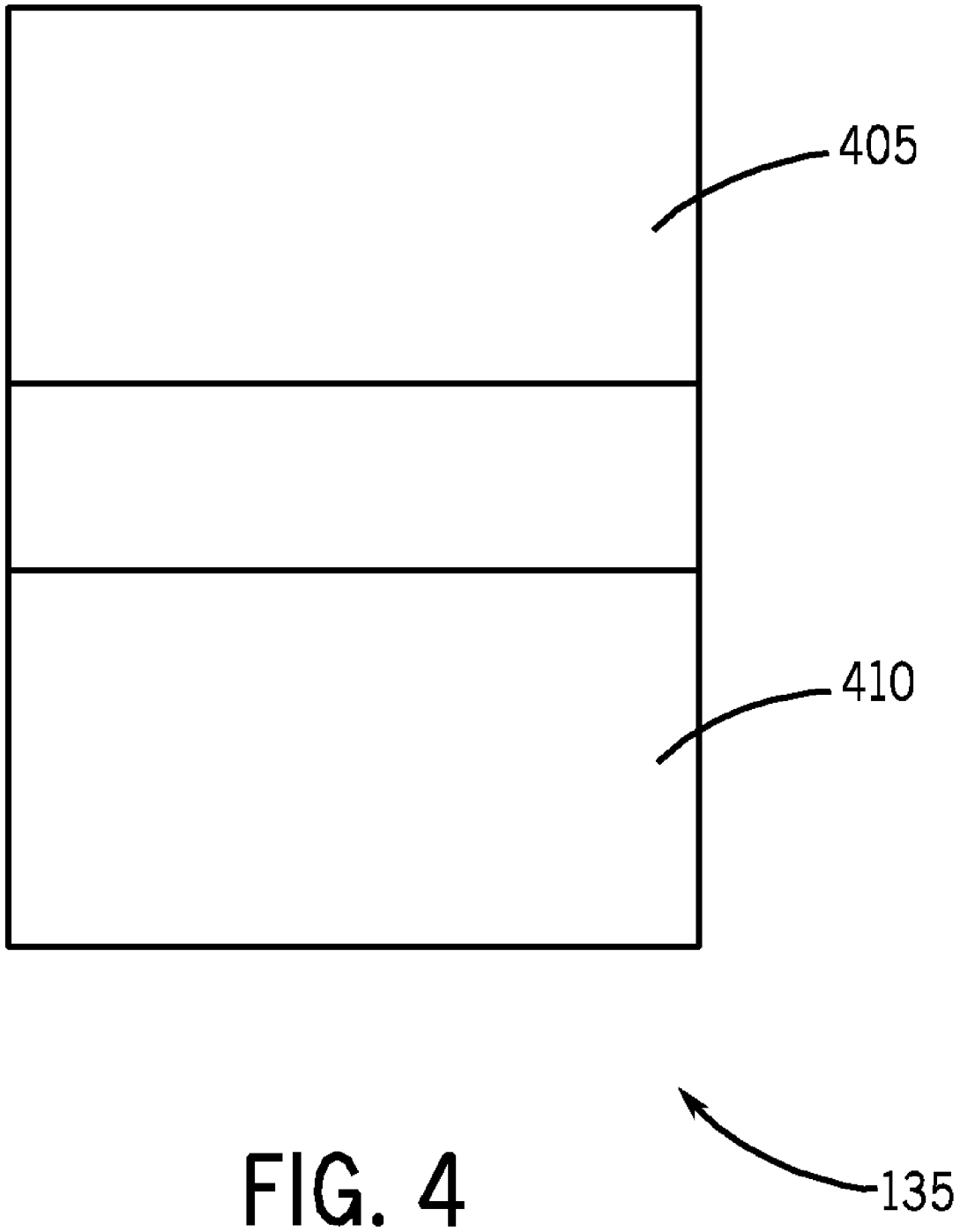
FIG. 4 shows a schematic diagram of a cathode cup in another embodiment.

Prior to being focused on the focal spot, the electrons beams emitted by the cathode filaments 302 and 304 are formed into a narrow, uniform stream by a cathode cup 135 (shown at FIG. 1) of cathode assembly 125. In one embodiment as shown in FIG. 4, the cathode cup 135 comprises at least two portions. A first portion 405 comprises an electrically conductive material and a second portion 410 comprises an electrically insulating material. The electrically conductive material comprises an electrically conductive ceramic selected from a group consisting of silicides, carbides, nitrides, and borides of at least one metal element selected from among Tungsten (W), Tantalum (Ta), Niobium (Nb), Titanium (Ti), Molybdenum (Mo), Zirconium (Zr), Hafnium (Hf), Vanadium (V) and Chromium (Cr).

The electrically insulating material comprises an electrically insulating ceramic selected from a group consisting of aluminum oxide, aluminum nitride, silicon nitride zirconium oxide, mullite, and magnesium oxide.

Referring back to FIG. 3, the cathode cup 135 is subdivided into three voltage biasing or deflection electrodes 306, 308 and 310. The first portion 405 comprising the electrically conductive material houses the cathode filaments 302 and 304 and the deflection electrodes 306, 308 and 310. The cathode filaments 302 and 304 and the electrostatic deflection electrodes 306, 308 and 310 are electrically insulated from the second portion 410. Further, the deflection electrodes 306, 308 and 310 are electrically insulated from each other. The deflection electrodes 306, 308 and 310 are selectively powered, through a filament select circuit switchably connected to the high voltage source 205. The deflection electrodes 306, 308 and 310 are connected to the filament select circuit by means of an electrical lead 315, which passes through the second portion 410 and is insulated from the second portion 410.

The filament select circuit provides selective and individual heating of one of the two filaments 302 and 304, depending upon the desired focal spot length for a particular application. The desired filament 302 or 304 is selected by the order in which the deflection electrodes 306, 308 and 310 are turned on or powered. More particularly, powering the deflection electrode 306 enables the filament 302, while turning on the deflection electrode 310 enables the filament 304.

The voltages are applied to the two deflection electrodes 306 and 310, and varied in the form of a square wave having a 180.degree phase shift between the two deflection electrodes 306 and 310. It is to be appreciated that the electrode voltages may be varied according to other waveforms as well. The oscillating voltages on the deflection electrodes 306 and 310 cause the emitted electron beam to oscillate between two impingement positions on the anode 120, hence the origin of the X ray beam shifts between two focal spots. Thus selective application of the electrical potential at each deflection electrode 306 and 310 can alter the focal point of the X ray beam generated therefrom.

As described above, the second portion 410 of the cathode cup 135 may comprise a plurality of insulating layers. The insulating layers are used to insulate the deflection electrodes 306, 308 and 310 from an electrical potential developed on the second portion 410 of the cathode cup 135. As the deflection electrodes 306, 308 and 310 are electrically isolated from the second portion 410, as well as from each other, each electron beam being emitted from the cathode cup 135 can be steered individually, according to an electrical field generated when the electrical potential is applied to the deflection electrodes 306, 308 and 310.

Figure 5:
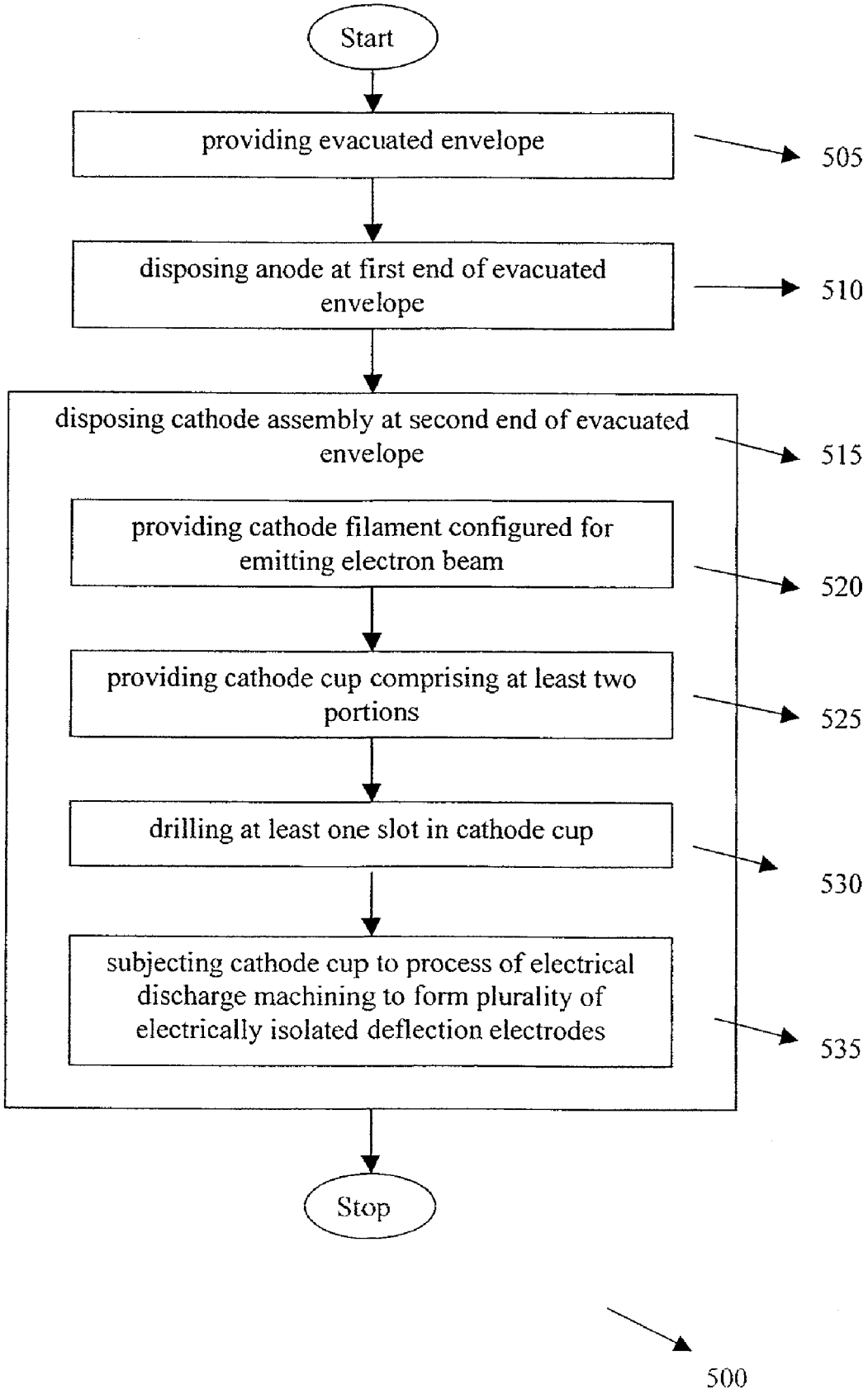
FIG. 5 shows a flow diagram of a method of manufacturing an X ray tube assembly in one embodiment.

In one embodiment a shown in FIG. 5, a method 500 of manufacturing the X ray tube assembly 105 is provided. The method 500 comprises providing the evacuated envelope 115 step 505, disposing the anode 120 at the first end of the evacuated envelope 115 step 510 and disposing the cathode assembly 125 at the second end of the evacuated envelope 115 step 515. The method of disposing the cathode assembly 125 (step 515) comprises providing the cathode filament 130 configured for emitting an electron beam to impinge on the anode 120 at a focal spot to generate X rays step 520, providing the cathode cup 135 comprising the first portion 405 and the second portion 410 step 525, drilling at least one slot 525 in the first portion 405 of the cathode cup 135 step 530 and subjecting the cathode cup 135 to a process of electrical discharge machining (EDM) to form a plurality of electrically isolated deflection electrodes 306, 308 and 310 step 535. The electrical discharge machining is a non-traditional method of machining that uses sparks to remove metal.

Figure 6:
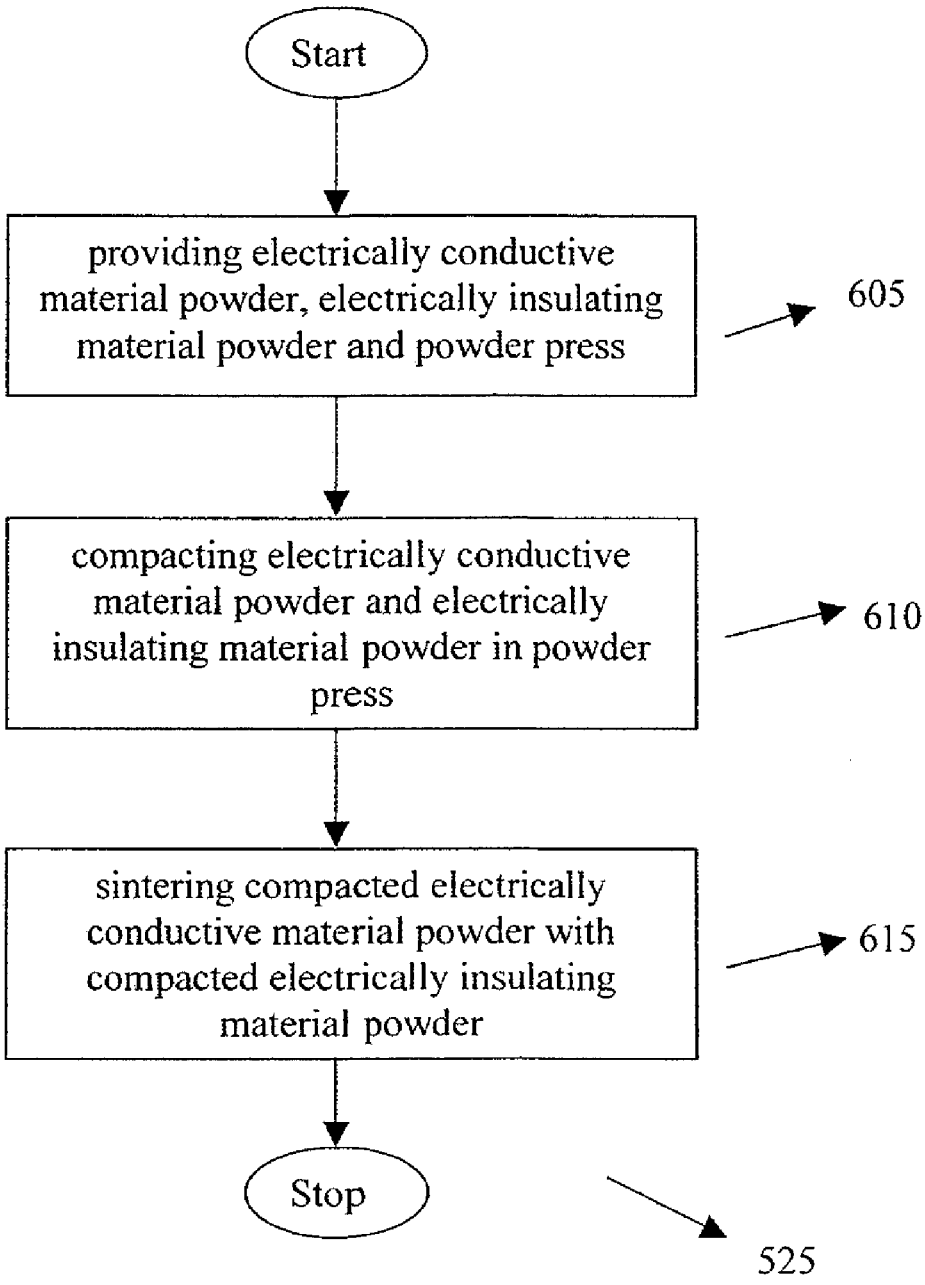
FIG. 6 shows a flow diagram of a method of providing a cathode cup in a radiation generator in one embodiment.

Further, a flow diagram of the method of providing the cathode cup 135 (step 525) is shown at FIG. 6. The method of providing the cathode cup 135 (step 525) comprises steps of providing an electrically conductive material powder, an electrically insulating material powder and a powder press step 605, compacting the electrically conductive material powder and the electrically insulating material powder in the powder press step 610 and sintering a compacted electrically conductive material powder with a compacted electrically insulating material powder step 615.

Figure 7:
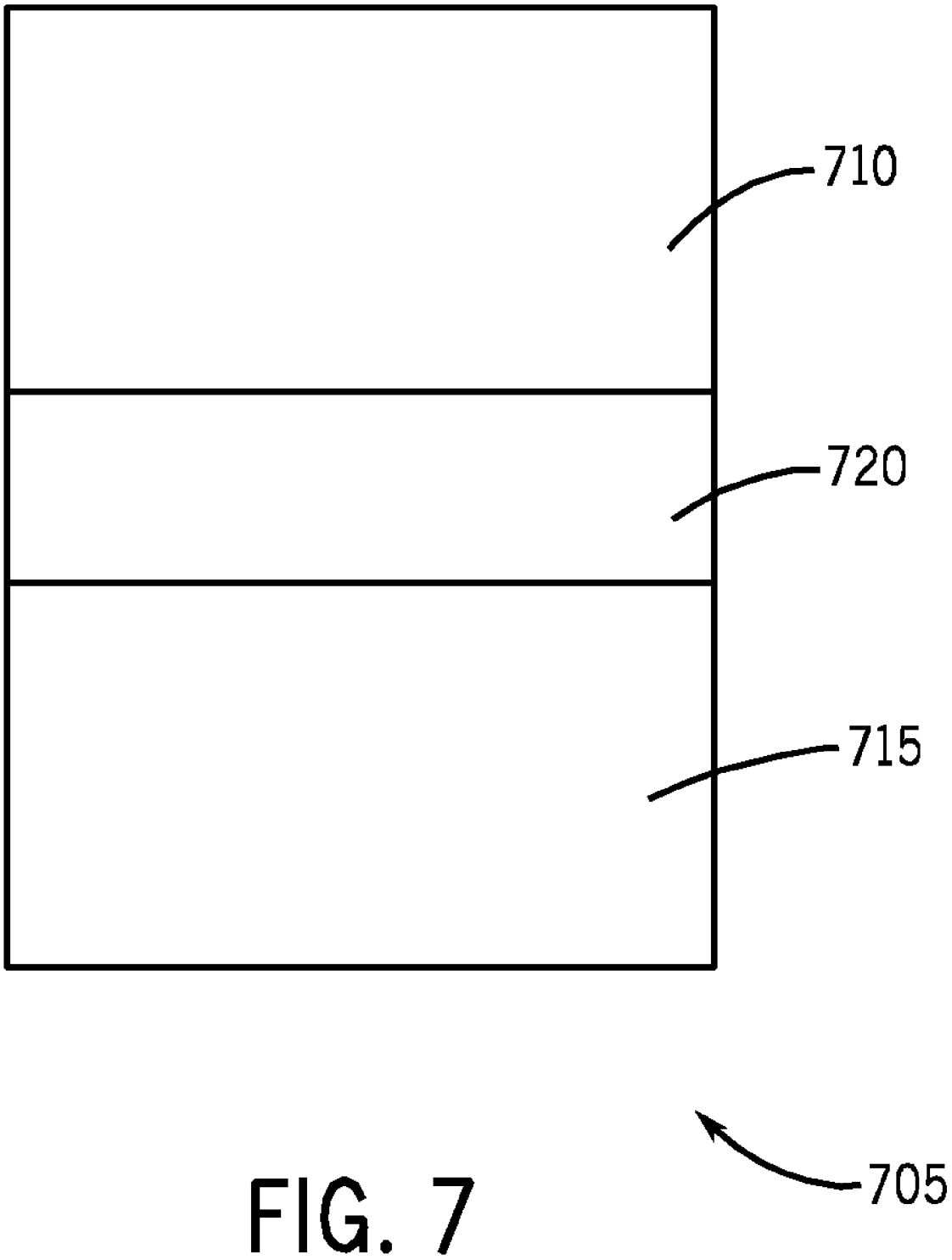
FIG. 7, FIG. 8, FIG. 9 and FIG. 10 each show a schematic diagram of a cathode cup in yet another embodiment.

FIG. 7, FIG. 8, FIG. 9 and FIG. 10, schematically and sequentially represent various stages of providing a cathode cup (step 525) for the radiation generator, in an exemplary embodiment. FIG. 7 shows a bi-ceramic cathode cup 705. The cathode cup 705 may be made up of multiple ceramics 710 and 715 with different material properties. The bi-ceramic cathode cup 705 comprises an electrically conductive ceramic 710 such as Titanium Diboride ($TiB_2$) and an electrically insulating ceramic 715 such as Alumina ($Al_2O_3$) and/or Aluminum Nitride (AlN). The electrically conductive ceramic 710 is hot pressed or sintered together with the electrically insulating ceramic 715. The bi-ceramic cathode cup 705 as shown in FIG. 7 includes a transitional area 720 formed during the process of providing the cathode cup 705. The transitional area 720 is typically in the range of few millimeters, extending between the electrically conductive ceramic 710 and the electrically insulating ceramic 715.

Figure 8:
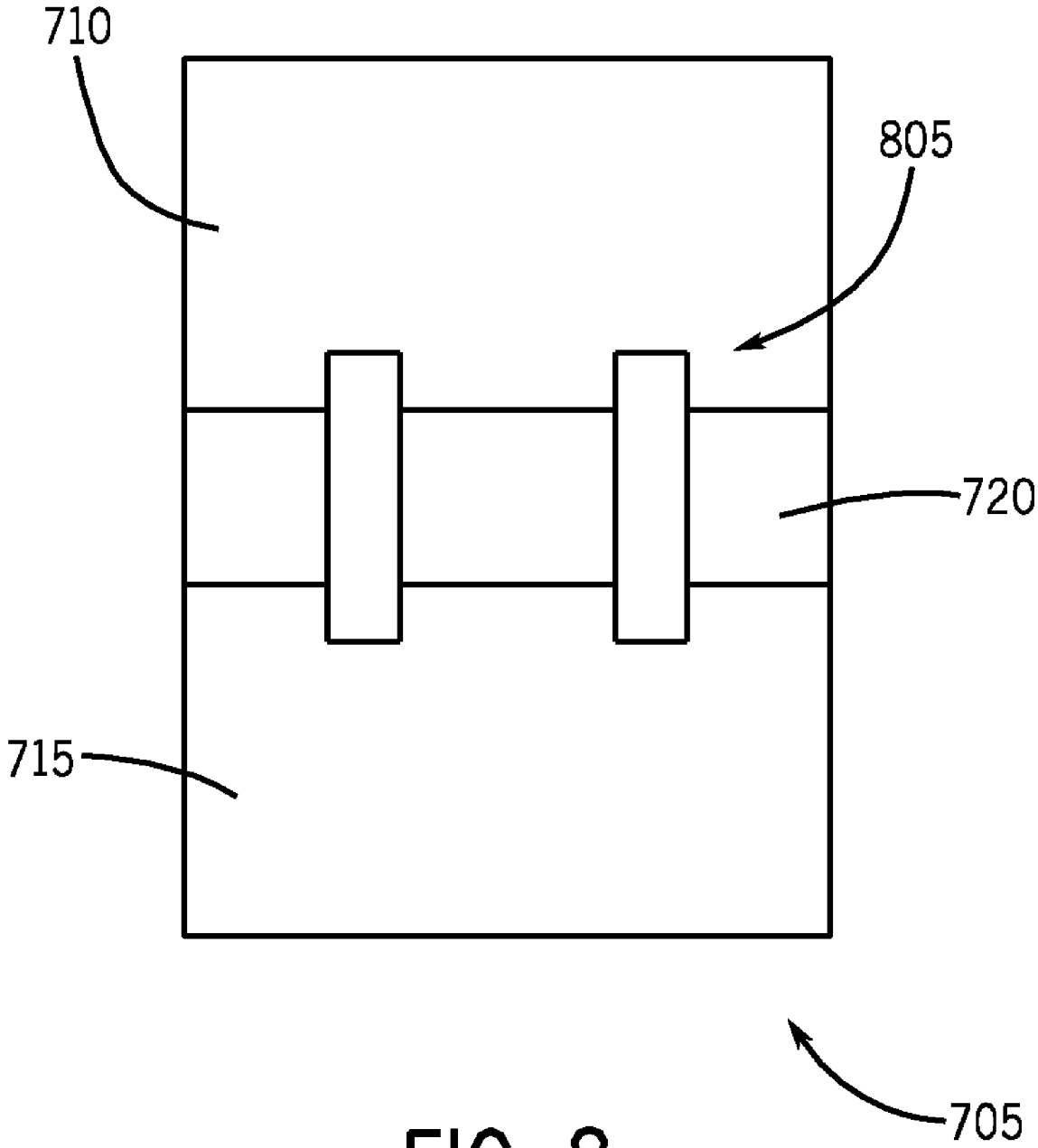
Figure 9:
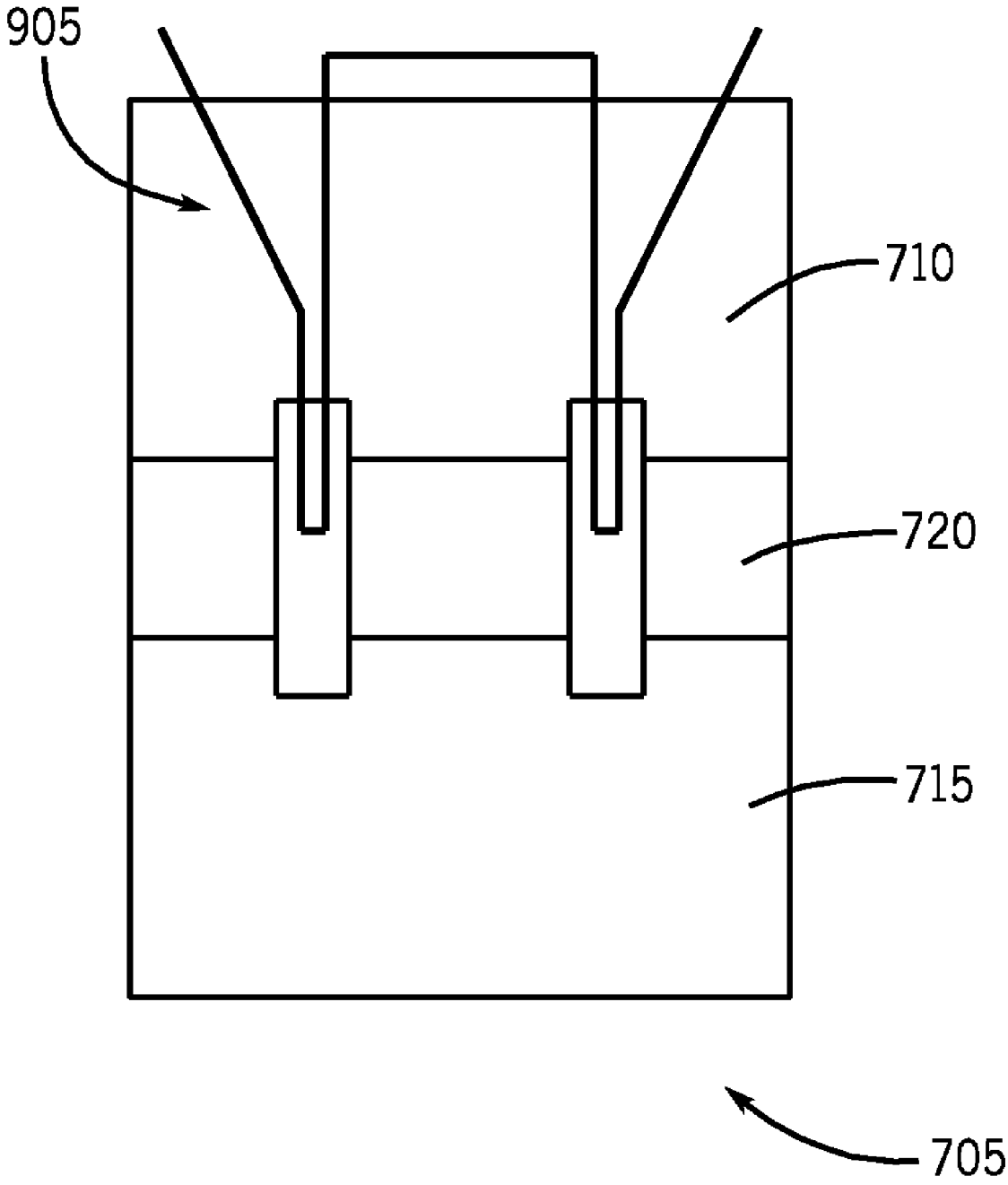
Figure 10:
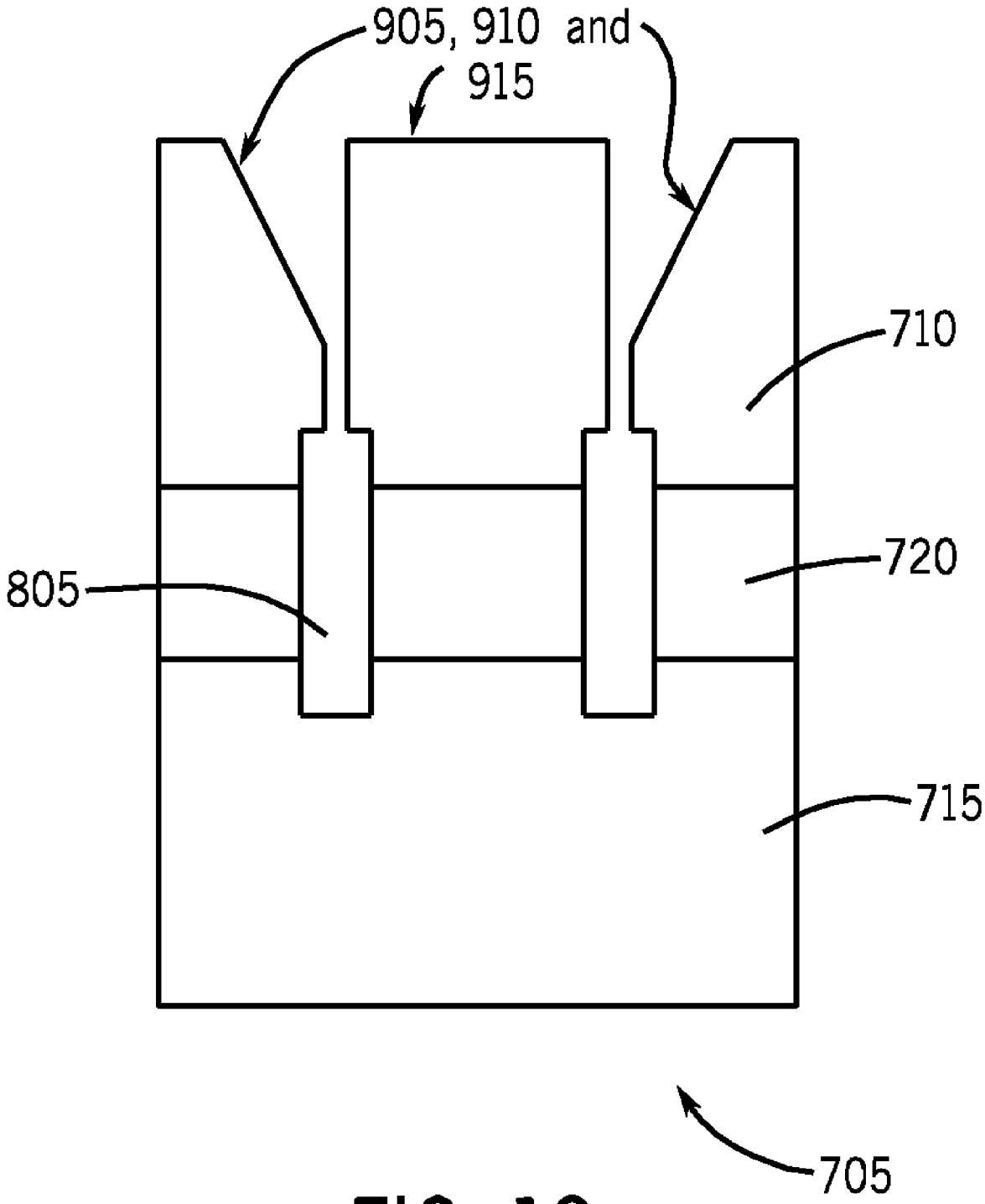

Referring to FIG. 8, one or more slots 805 can be drilled into the bi-ceramic cathode cup 705, which span the transitional area 720. In order to allow for the electrically conductive ceramic 710 to be separated into multiple deflection electrodes the process of electrical discharge machining (EDM) can be used. As shown in FIG. 9, the slots 805 drilled prior to the EDM operation, allow for complete separation of the deflection electrodes (shown at 905) following the EDM process. FIG. 10 shows a plurality of electrically isolated deflection electrodes 905, 910 and 915 formed in the electrically conductive ceramic 710, as a result of the EDM operation on the bi-ceramic cathode cup 705.

The method of manufacturing the X ray tube assembly, as described in various embodiments, comprises a method of making a plurality of electrically isolated deflection electrodes in a limited space for the electrostatic control of the focal spot.

The process of making electrically isolated deflection electrodes, as described in various embodiments, does not include brazing, thereby avoiding braze overflow, voids and ceramic cracking, etc. Thus, the process may allow for the use of materials, such as various types of ceramics, that exhibit inability to withstand stresses incurred during brazing.

The method makes use of material property gradients built into a single cathode cup in order to obtain desired properties. This allows the electro statically deflecting cathodes to be electrically conductive and insulating when desired.

In various embodiments of the invention, a cathode assembly for a radiation generator and a radiation generator using a cathode assembly are described. However, the embodiments are not limited and may be implemented in connection with different applications. The application of the invention can be extended to other areas, for example medical imaging systems, industrial inspection systems, security scanners, particle accelerators, etc. The invention provides a broad concept of designing a cathode assembly, which can be adapted in similar radiation generators. The design can be carried further and implemented in various forms and specifications.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method of manufacturing an X ray tube assembly, the method comprising:

providing an evacuated envelope;

disposing an anode at a first end of the evacuated envelope;

disposing a cathode assembly at a second end of the evacuated envelope, the method of disposing the cathode assembly comprising:

providing first and second cathode filaments, each configured for emitting an electron beam to impinge on the anode at a focal spot to generate X rays;

providing a cathode cup comprising at least a first portion and a second portion, wherein the first portion comprises an electrically conductive ceramic and the second portion comprises an electrically insulating ceramic; and wherein the first portion comprises first, second and third electrically isolated deflection electrodes configured for selective and individual heating of one of the first cathode filament and the second cathode filament depending upon a desired focal spot.

2. The method of claim 1, wherein the method of providing the cathode cup comprises:

providing an electrically conductive ceramic powder, an electrically insulating ceramic powder and a powder press;

compacting the electrically conductive ceramic powder and the electrically insulating ceramic powder in the powder press; and sintering the compacted electrically conductive ceramic powder with the compacted electrically insulating ceramic powder.

3. The method of claim 1, wherein the electrically conductive ceramic is selected from a group consisting of silicides , carbides, nitrides, and borides of at least one metal element selected from among Tungsten (W), Tantalum (Ta), Niobium (Nb), Titanium (Ti), Molybdenum (Mo), Zirconium (Zr), Hafnium (Hf), Vanadium (V) and Chromium (Cr).

4. The method of claim 1, wherein the electrically insulating ceramic is selected from a group consisting of aluminum oxide, aluminum nitride, silicon nitride zirconium oxide, mullite, and magnesium oxide.

5. An X ray tube assembly comprising:

an evacuated envelope;

an anode disposed at a first end of the evacuated envelope;

a cathode assembly disposed at a second end of the evacuated envelope, the cathode assembly comprising:

first and second cathode filaments; and a cathode cup defining a plurality of deflection electrodes, the plurality of deflection electrodes being electrically isolated from each other;

wherein the cathode cup comprises at least two portions, a first portion comprising an electrically conductive ceramic and a second portion comprising an electrically insulating ceramic; and wherein the first portion comprises the plurality of deflection electrodes configured for selective and individual heating of one of the first cathode filament and the second cathode filament depending upon a desired focal spot.

6. The X ray tube assembly of claim 5, wherein the electrically conductive ceramic is selected from a group consisting of silicides, carbides, nitrides, and borides of at least one metal element selected from among Tungsten (W), Tantalum (Ta), Niobium (Nb), Titanium (Ti), Molybdenum (Mo), Zirconium (Zr), Hafnium (Hf), Vanadium (V) and Chromium (Cr).

7. The X ray tube assembly of claim 5, wherein the electrically insulating ceramic is selected from a group consisting of aluminum oxide, aluminum nitride, silicon nitride zirconium oxide, mullite, and magnesium oxide.

8. The X ray tube assembly of claim 5, is a part of a computerized tomography system.

9. The X ray tube assembly of claim 5, is a part of an X ray imaging device.

10. A method of operating an X ray tube assembly, the method comprising steps of:

selectively and individually heating one of a first cathode filament and a second cathode filament to emit an electron beam having a desired focal spot;

maintaining a voltage potential between an anode and a cathode assembly to cause the electron beam to strike the anode at the desired focal spot to generate X rays; and applying voltage potential individually and selectively to a plurality of electrically isolated deflection electrodes in a cathode cup, for controlling the width and location of the desired focal spot on the anode;

wherein the cathode cup comprises at least two portions, a first portion comprising an electrically conductive ceramic and a second portion comprising an electrically insulating ceramic; and wherein the first portion comprises the plurality of deflection electrodes.

11. A cathode cup for a radiation generator, the cathode cup comprising at least two portions, a first portion comprising an electrically conductive ceramic and a second portion comprising an electrically insulating ceramic; and wherein the first portion of the cathode cup comprises first, second and third electrically isolated deflection electrodes.

12. The cathode cup of claim 11, wherein the electrically conductive ceramic is selected from a group consisting of silicides, carbides, nitrides, and borides of at least one metal element selected from among Tungsten (W), Tantalum (Ta), Niobium (Nb), Titanium (Ti), Molybdenum (Mo), Zirconium (Zr), Hafnium (Hf), Vanadium (V) and Chromium (Cr).

13. The cathode cup of claim 11, wherein the electrically insulating ceramic is selected from a group consisting of aluminum oxide, aluminum nitride, silicon nitride zirconium oxide, mullite, and magnesium oxide.

14. The cathode cup of claim 11, wherein the radiation generator is an X ray tube assembly.

15. The cathode cup of claim 11, wherein the radiation generator is a part of a computerized tomography system.

* * * * *